US010875041B2

(12) United States Patent
Kim et al.

(10) Patent No.: US 10,875,041 B2
(45) Date of Patent: Dec. 29, 2020

(54) DEVICE FOR PACKAGING AND DISPENSING PRODUCT COMPRISING MOVEABLE PISTON AND PUMP SYSTEM

(71) Applicant: L'Oreal, Paris (FR)

(72) Inventors: Jinseok Kim, Shanghai (CN); Vincent Jacquart, Shanghai (CN); Stéphane Leroux, Shanghai (CN)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/477,046

(22) PCT Filed: Jan. 10, 2017

(86) PCT No.: PCT/CN2017/070714
§ 371 (c)(1),
(2) Date: Jul. 10, 2019

(87) PCT Pub. No.: WO2018/129646
PCT Pub. Date: Jul. 19, 2018

(65) Prior Publication Data

US 2019/0388920 A1 Dec. 26, 2019

(51) Int. Cl.
*B05B 11/02* (2006.01)
*B05B 11/00* (2006.01)
*B65D 83/00* (2006.01)

(52) U.S. Cl.
CPC ..... *B05B 11/02* (2013.01); *B05B 11/3097* (2013.01); *B65D 83/0038* (2013.01); *B65D 83/0094* (2013.01)

(58) Field of Classification Search
CPC . B05B 11/02; B05B 11/3097; B65D 83/0038; B65D 83/0094
(Continued)

(56) References Cited

U.S. PATENT DOCUMENTS 2,228,435 A * 1/1941 Binon ..... A47G 19/183 222/179.5
8,403,182 B2 3/2013 Lee
(Continued)

FOREIGN PATENT DOCUMENTS

CN 2693693 Y 4/2005
CN 101905782 A 12/2010
(Continued)

OTHER PUBLICATIONS

International Search Report issued in corresponding PCT/CN2017/070714 filed Jan. 10, 2017, dated May 3, 2017, 4 pages.

*Primary Examiner* — Donnell A Long
(74) *Attorney, Agent, or Firm* — Christensen O'Connor Johnson Kindess PLLC

(57) ABSTRACT

A device (10) for packaging and dispensing a product comprises a container (12), a moveable piston (16) mounted inside the container (12) and delimiting one compartment (22) containing the product, and a dispensing member (14) mounted on the container (12) and comprising at least one outlet orifice (24) in communication with the compartment (22). The device (10) further comprises a pump system (18) mounted on the container (12) axially on the side opposite to the dispensing member (14) and comprising a push-button (28). Said pump system (18) is configured so that exerting a pressure on the push-button (28) results in a forward displacement of the piston (16) inside the container (12) towards the dispensing member (14) and subsequent releasing of said push-button (28) results in a backward displacement of said piston (16) away from said dispensing member (14).

13 Claims, 4 Drawing Sheets

Figure 1:
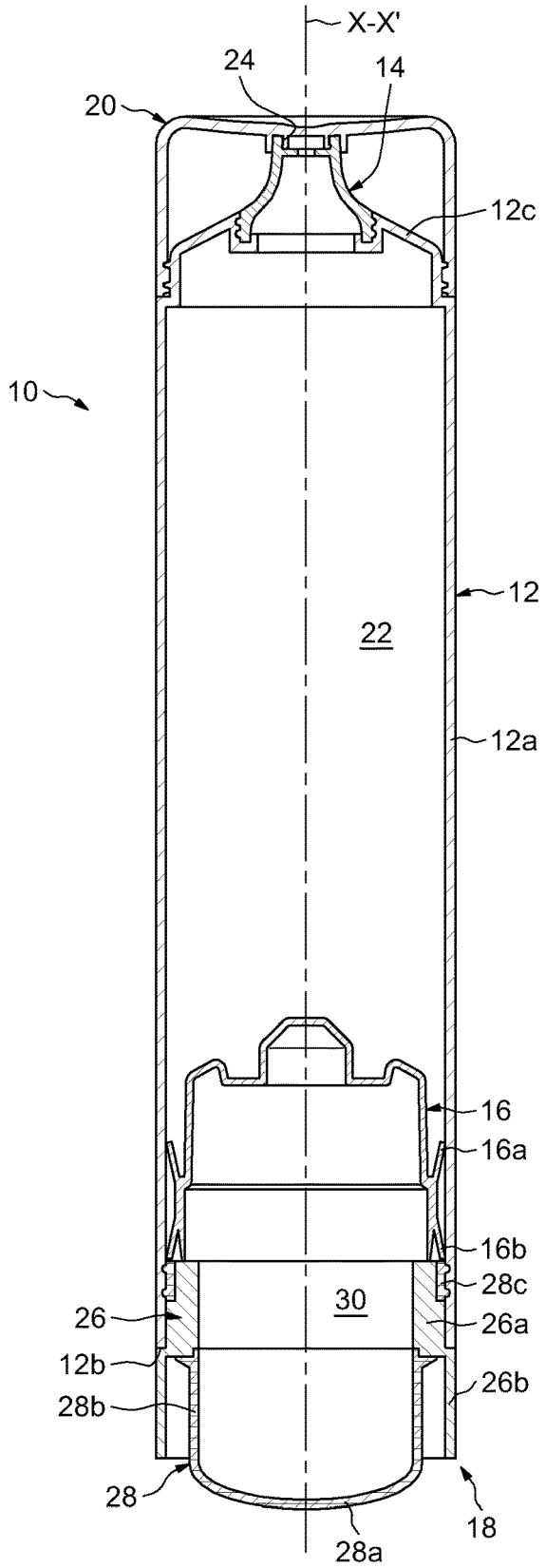

(58) Field of Classification Search
USPC ..... 222/386, 326, 109
See application file for complete search history.

(56) References Cited

U.S. PATENT DOCUMENTS

| | | | | |
|---|---|---|---|---|
| 2004/0074923 | A1 | 4/2004 | Bang | |
| 2011/0101035 | A1* | 5/2011 | Beebe | A61M 5/31513 222/386 |
| 2015/0272840 | A1* | 10/2015 | Liu | A61K 8/06 424/401 |
| 2016/0303004 | A1* | 10/2016 | Ma | A61K 8/37 |
| 2017/0042774 | A1* | 2/2017 | Shimizu | A61K 8/345 |

FOREIGN PATENT DOCUMENTS

| | | | | |
|---|---|---|---|---|
| CN | 201665372 | U | | 12/2010 |
| CN | 203064485 | U | * | 7/2013 |
| CN | 203064485 | U | | 7/2013 |
| CN | 204685379 | U | | 10/2015 |
| DE | 3202275 | A1 | | 8/1983 |
| JP | S5199808 | U | | 8/1976 |

* cited by examiner 10
12
14
16
18
22
24
26
28
28a
28b
30
32
34
36
X-X'

DEVICE FOR PACKAGING AND DISPENSING PRODUCT COMPRISING MOVEABLE PISTON AND PUMP SYSTEM

The present invention relates to the general field of devices for packaging and dispensing a liquid or a semi-liquid product.

More particularly, the present invention relates to a device comprising a container, a moveable piston disposed inside said container and delimiting one compartment inside which is housed the product to be dispensed, and a manual pump mounted on the container at the side opposite to a dispensing member to deliver such product.

Classically, such device comprises an air pump provided with a push-button delimiting together with the piston a chamber. The push-button is provided with an air inlet orifice in communication with said chamber. The push-button is made in a resilient material to be elastically deformable. Document JPS5199808U describes such a device.

To dispense the product contained into the container, the user closes the air inlet with one of its fingers and exerts an axial pressure inwards on the push-button. This produces a deformation of the push-button and an increase of the pressure within the chamber delimited by said push-button and the piston, thereby moving the piston against the product to be dispensed. Accordingly, the product is discharged through the dispensing member. In use, the piston is progressively displaced along the container.

Then, upon release of the push-button by the user, said push-button returns back to its inactive position by elasticity. Besides, the air inlet of the push-button allows for the inflow of air from the outside into the chamber delimited by said push-button and the piston. For more details, it is possible for example to refer to documents U.S. Pat. No. 8,403,182 or US 2004/0074923.

The applicant has observed that, especially when a composition with low viscosity is housed, a residual dripping phenomenon may occur even after the return of the push-button to the inactive position and before the closure of the dispensing member with a cap. As a matter of fact, after dispensing the composition, a small residual pressure still remains into the compartment inside which is housed said composition.

In practice, such devices are often limited to the dispensing of highly viscous or even pasty products such as toothpaste.

It is a particular object of the present invention to overcome this drawback.

More particularly, the object of the present invention is to provide a device comprising a moveable piston and having a structure adapted for minimizing such dripping phenomenon even with low viscosity compositions.

The invention relates to a device for packaging and dispensing a product comprising a container, a moveable piston mounted inside the container and delimiting one compartment containing the product, and a dispensing member mounted on the container and comprising at least one outlet orifice in communication with the compartment.

According to a general feature, the device further comprises a pump system mounted on the container axially on the side opposite to the dispensing member and comprising a push-button.

Said pump system is configured so that exerting a pressure on the push-button results in a forward displacement of the piston inside the container towards the dispensing member, and subsequent releasing of said push-button results in a backward displacement of said piston away from said dispensing member.

By arranging the pumping system so that after having dispensed some product, the piston is displaced backward, release of the push-button will result in some air sucking back into the compartment of container from the dispensing member itself like a "sniffing" phenomenon.

This "sniffing" action will prevent having some residual overpressure inside the product compartment and will help the product in the dispensing member to return inside said compartment. Such a configuration strongly limits any dripping phenomenon.

In the present invention, the piston of the device moves back towards the push-button after having dispensed some product contrary to a conventional dispensing device wherein the piston only moves towards the dispensing member so that said piston progressively displaced along the container. In the present invention, the piston acts as a reciprocating piston.

In one embodiment, the push-button of the pump system is made from elastically deformable material. Said push-button and the piston axially may delimit a chamber separate from the compartment. The volume of the chamber being variable upon deformation of the push-button. Said variable volume chamber is not in communication with the outside via the pump system.

A "chamber not in communication with the outside" should be understood as meaning a total and durable absence of communication between the chamber and the exterior. There is no air inlet provided on the pump system to allow for the inflow of air from the exterior into the chamber, or valve that is capable of taking up an open state and a closed state enabling the chamber to be put into communication with the exterior.

The variable volume chamber remains not in communication with the outside whatever the position of the push-button. The pump system is a pump system without air intake.

According to a specific configuration, the push-button may comprise a sealing skirt engaging into the container in a leaktight manner. Thus, the sealing properties between the container and the pump system are enhanced.

The pump system may further comprise a cap body mounted on the container, at least one portion of the push-button being movable relative to the cap body. The push-button may be secured to said cap body.

In another embodiment, the pump system further comprises a pushing rod secured to the piston and onto which is mounted the push-button.

The pump system may further comprise a cap body mounted on the container for closing off said container, the push-button being movable relative to said cap body. Preferably, the pushing rod extends through the cap body of the pump system, preferably in a leaktight manner.

In such embodiment, the push-button may be made from rigid material. Accordingly, the push-button may be easily decorated, painted and/or varnished. For example, the decoration may include a logo, a brand mark, a design, or any other inscription or distinctive sign.

In order to obtain an automatic return of the push-button from an actuated position to a deactuated position after releasing of said push-button, the pump system may further comprise at least one an elastic element disposed around the pushing rod for biasing said push-button outwards. Said elastic element may be interposed between the push-button and the cap body.

Preferably, the product contained in the compartment may have a viscosity below 25 (M3) UD. The viscosity measurement is generally performed at 25° C., using a Rheomat RM180 viscometer equipped with a M3 spindle, the measurement being performed after 10 minutes of rotation of the spindle in the composition (after which time stabilization of the viscosity and of the spin speed of the spindle are observed), at a shear rate of 200 rpm. For information, 12-22 (M3) UD corresponds to 46-60 (M2) UD which is calculated around 280-420 CPS.

Figure 6:
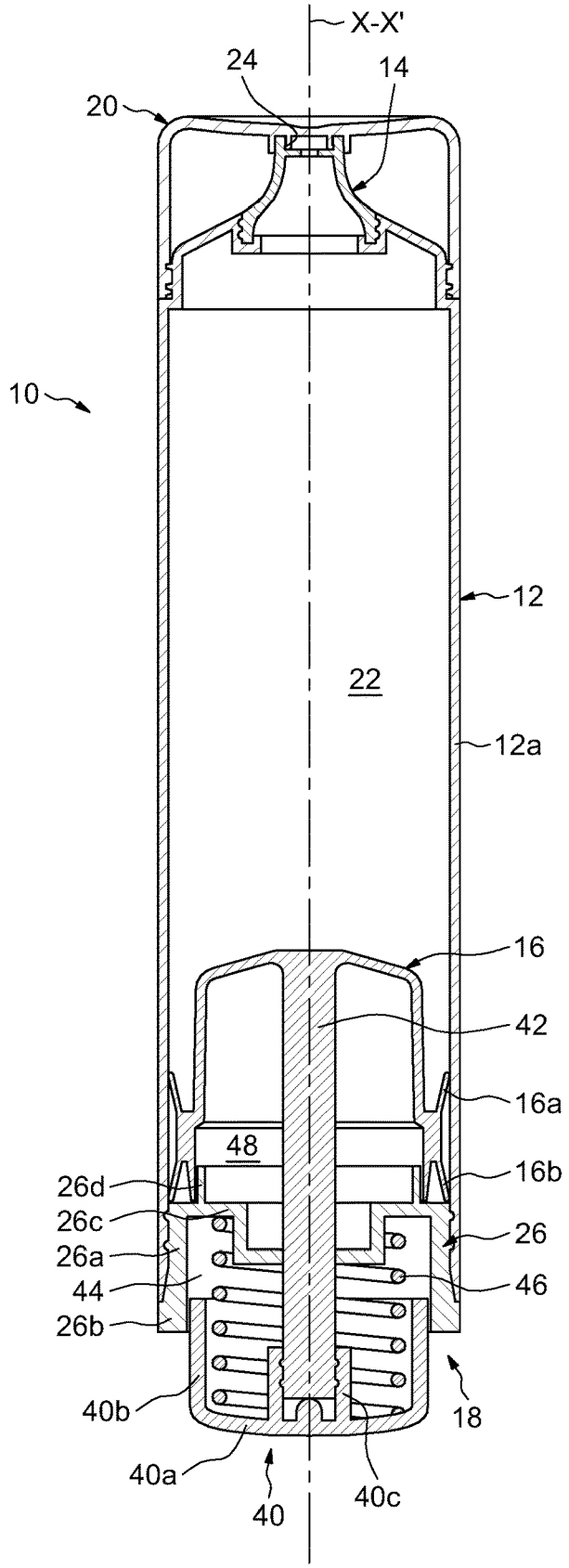
Figure 9:
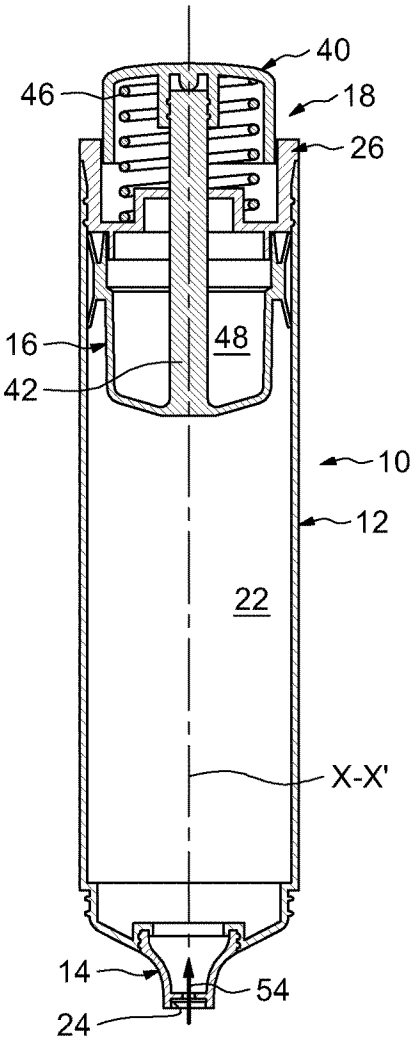
Figure 8:
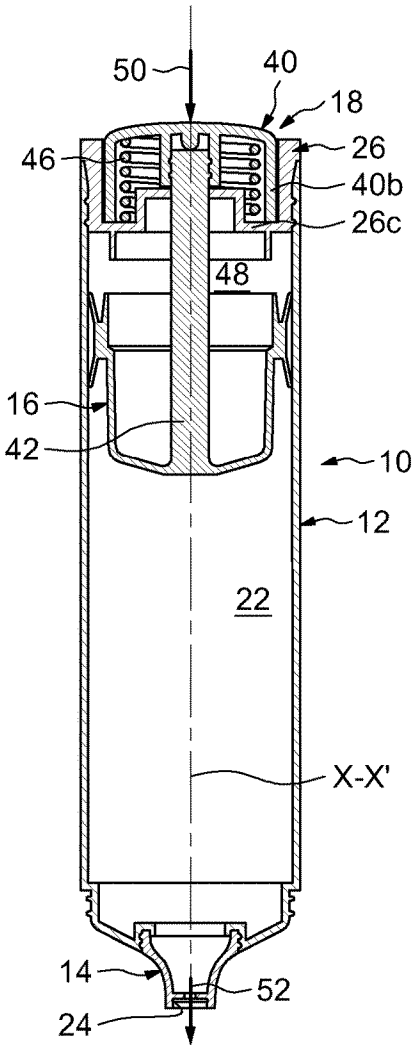
Figure 7:
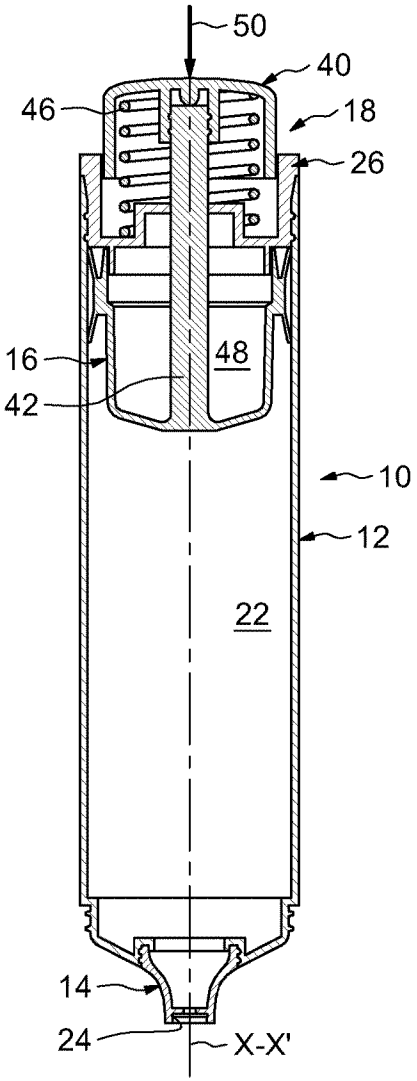

The present invention and its advantages will be better understood by studying the detailed description of specific embodiments given by way of non-limiting examples and illustrated by the appended drawings on which:

FIG. 1 is a cross-section of a device according to a first example of the invention, FIGS. 2 to 5 are cross-sections of the device of FIG. 1 in use, FIG. 6 is a cross-section of a device according to a second example of the invention, and FIGS. 7 to 9 are cross-sections of the device of FIG. 6 in use.

FIG. 1 shows an example of a device, denoted by the general reference number 10, for packaging and dispensing a product (not shown) for example a liquid or a semi-liquid cosmetic product. The expression "cosmetic product" is understood to mean a product as defined in Article 2 of Regulation No. 1223/2009 of the European Parliament and of the Council of 30 Nov. 2009. The device 10 may also be used for packaging other types of products.

FIG. 1 represents the device 10 in a state that is assumed to be vertical. The device 10 has a longitudinal axis X-X'. The device 10 comprises a container 12, a dispensing plug 14 mounted on the container, a movable piston 16 mounted inside the container, and a pump system 18 axially mounted on said container on the side opposite to the dispensing plug 14 with respect to the piston 16. Here, the device 10 further comprises a closure cap 20 mounted on the container 12 for closing off the dispensing plug 14.

As will be described later, the pump system 18 is configured for allowing passage of air into the container 12 only via the dispensing plug 14.

The piston 16 is mounted axially slidably into the container 12 along the axis X-X'. The piston 16 delimits inside the container 12 a compartment 22 containing the product to be dispensed under pressure. The compartment 22 which contains the product is in communication with the dispensing plug 14.

The piston 16 bears against the inner surface of a peripheral wall 12*a* of the container. To this end, in the illustrated example, the piston 16 comprises two friction sealing lips 16*a*, 16*b* coming into friction contact the peripheral wall 12*a* of the container. The lips 16*a*, 16*b* extend in opposite direction. The lip 16*a*, which extends axially on the side of the dispensing plug 14, acts as a scraper lip during a movement of the piston 16 towards the dispensing plug 14. The lip 16*b*, which extends axially on the side of the pump system 18, is adapted to prevent any inlet of air into the compartment 22. The piston 16 fits inside the container 12 in a leaktight manner while maintaining its freedom to slide.

In the illustrated example, the profile of the piston 16 is chosen appropriately so as to optimize the degree to which the container 12 is emptied. For example, the upper end of piston 16 is contoured to complement the upper end of the container 12 so as to minimize the volume of the compartment 22 when the piston 16 is located at its uppermost position, adjacent to the dispensing plug 14. Alternatively, the piston 16 may have a different shape, for example cylindrical.

The container 12 extends along the axis X-X'. The container 12 comprises a bottom end 12*b* delimiting an opening which is closed by the pump system 18, an upper end wall 12*c* axially opposite to the bottom end 12*b*, and the peripheral wall 12*a* extending axially between said bottom end and upper end wall. The compartment 22 is axially delimited by the piston 16 and the end wall 12*c* of the container. The container 12 is made in one part. For example the container 12 may be made from moulding of plastic material. Alternatively, the container 12 may be made in metallic material.

The dispensing plug 14 is mounted on the upper end wall 12*c* in a leaktight manner. In the illustrated example, a groove (not referenced), which is oriented axially on the side opposite to the compartment 22, is provided on the container 12 for the mounting of the dispensing plug 14. Alternatively, the dispensing member 14 may be mounted on the container 12 by any other appropriate means, for example by screwing.

The dispensing plug 14, coaxial with the axis X-X', comprises a dispensing or outlet orifice 24 in fluidly communication with the compartment 22 of the container. The orifice 24 is coaxial with the axis X-X'. The dispensing plug 14 has a hollow shape. The plug 14 is made in one part, for example from rigid plastic material such as polyethylene (PE), polypropylene (PP), etc.

The pump system 18 comprises a cap body 26 secured to the bottom end 12*b* of the container, and an airless push-button 28 for delivering a dose of product in response to an actuating command. The push-button 28 is secured to the cap body 26.

The cap body 26 sealingly engages into the peripheral wall 12*a* of the container. The cap body 26 comprises an annular inner skirt 26*a* in friction radial contact with said peripheral wall 12*a*, and an outer annular flange 26*b* extending axially said inner skirt axially on the side opposite to the container 12 and mounted in axial contact against the bottom end 12*b* of said container. The piston 16 axially abuts against the cap body 26, namely against the skirt 26*a*. The cap body 26 is made in one part, for example from rigid plastic material.

The airless push-button 28 of the pump system axially delimits together with the piston 16 a chamber 30. The push-button 28 is deprived of through-hole made into its thickness and opening into the chamber 30. The chamber 30 is not in communication with the outside via the push-button 28. The chamber 30 is separate from the compartment 22 by the piston 16. The chamber 30 is not in communication with the compartment 22 via the piston 16. The chamber 30 may be delimited by the push-button 28, the inner skirt 26*a* of the cap body, the piston 16 and also the container 12 depending on the position of said piston. When no pressure is exerted on the push-button 28, the chamber 30 may be substantially at atmospheric pressure.

The push-button 28 is made from elastically deformable material. The push-button 28 may be made from synthetic material such as plastic material or elastomer or nitrile rubber or polyurethane, etc. The push-button 28 is secured to the cap body by any appropriate means, for example by overmoulding, gluing, etc. Here, the push-button 28 is secured to the inner skirt 26*a* of the cap body.

In the illustrated example, the push-button 28 is made in one part. The push-button 28 comprises a frontal wall 28*a* and an annular peripheral wall 28*b* extending axially said wall towards the container 12. The peripheral wall 28*b*, coaxial with the axis X-X', extends a large-diameter of the frontal wall 28*a*. The peripheral wall 28*b* is secured to the skirt 26*a* of the cap body 26. The push-button 28 remains radially spaced apart from the flange 26*b* of said cap body.

The push-button 28 further comprises an annular sealing skirt 28*c* radially interposed between the skirt 26*a* of the cap body and the peripheral wall 12*a* of the container. The sealing skirt 28*c* is in radial contact against the peripheral wall 12*a* on one side and in radial contact with the skirt 26*a* on the other side. The sealing skirt 28*c* extends from the peripheral wall 28*b*.

In the disclosed example, the sealing skirt 28*c* of the push-button comprises annular ribs (not referenced) engaging into recesses formed on the peripheral wall 12*a* of the container. The sealing skirt 28*c* is thus secured to the container 12 by snap-fitting. Alternatively, the fixation between these two elements may be made by gluing, etc.

Figures 2, 3, 4, 5:
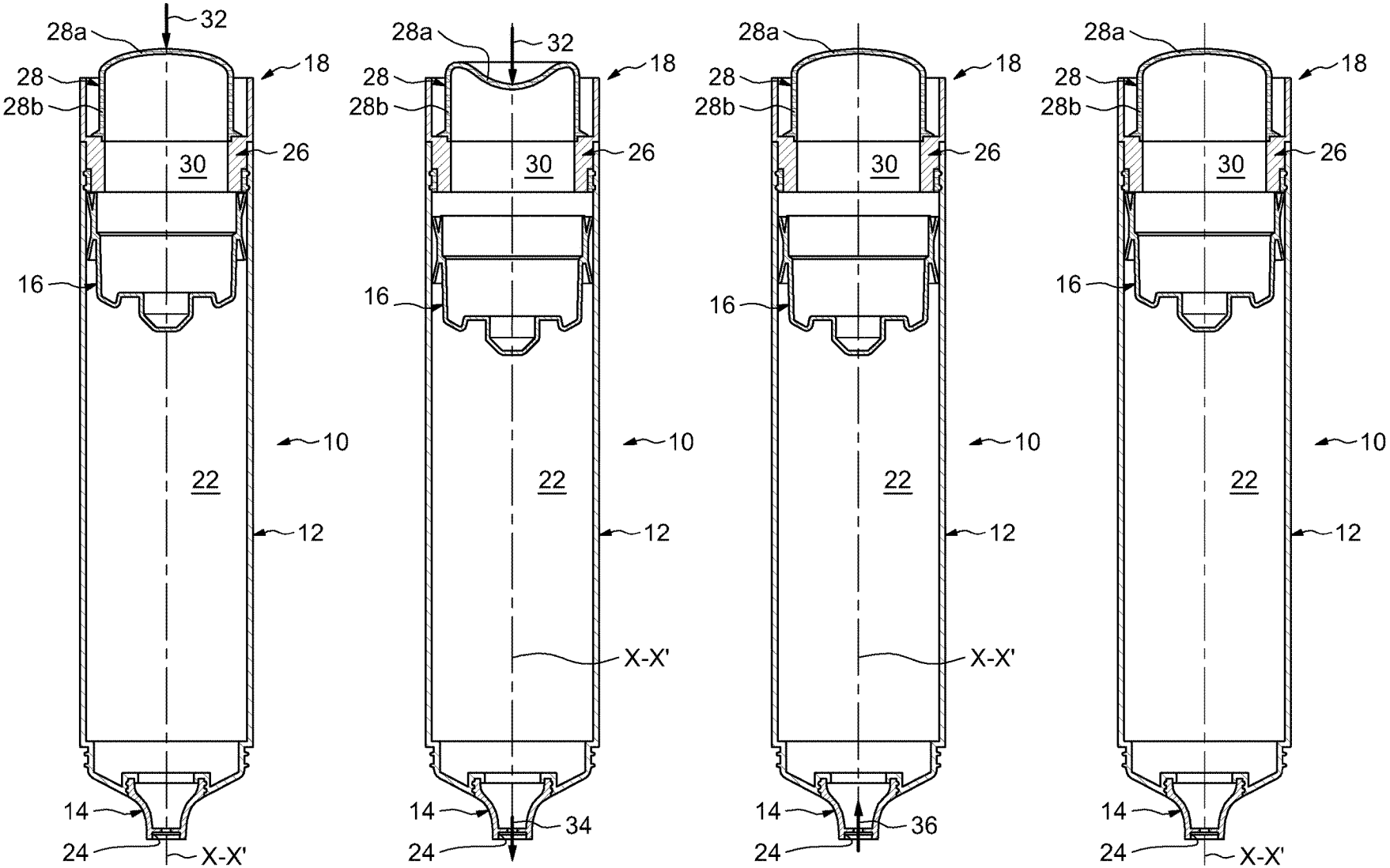

As illustrated on FIG. 2, once the cap has been removed, to distribute the product contained into the compartment 22 the user may orient the device 10 with the container 12 located above the dispensing plug 14. Alternatively, the device 10 may be oriented in an inverted position, i.e. with the dispensing plug 14 located above the container 12, or in a horizontal position.

The user exerts an axial pressure inwards on the deformable push-button 28. Such pressure is illustrated schematically by the arrow referenced 32 which is applied on the frontal wall 28*a* of the deformable push-button.

As shown on FIG. 3, with the pressure exerted by the user, there is a deformation of at least the frontal wall 28*a* of the push-button. With such deformation, a portion of the push-button 28 moves towards the container 12. Said movement of the push-button 28 produces a reduction of the volume of the chamber 30 and thus an increase of the pressure within said chamber, thereby moving the piston 16 towards the dispensing plug 14, as shown on FIG. 3.

The pressure exerted by the user results in a forward displacement of the piston 16 inside the container 12 towards the dispensing plug 14. Accordingly, the product is discharged through said plug 14 as illustrated schematically by the arrow 34. The push-button 28 is moveable between an inactive position and an active position wherein said push-button is deformed to compress air confined in the chamber 30.

After the distribution of the product and upon release of the pressure exerted by the user, the push-button 28 returns back to its initial position by elasticity as shown on FIG. 4.

Simultaneously, an air intake into the compartment 22 of the container is achieved by the dispensing plug 14. As illustrated schematically by the arrow 36, some air is sucked back into the compartment 22 by the orifice 24 of the dispensing plug. Air bubbles may move towards the piston 16 since the composition is fluid. For example, the product contained into the compartment 22 may have a viscosity below 25 (M3) UD.

The air sucked into the compartment 22 exerts a pressure on the piston 16. Accordingly, the releasing of the push-button 28 results in a backward displacement of the piston 16 away from the dispensing plug 14, i.e. towards the push-button 28. The piston 16 returns to its initial position as shown on FIG. 5, here in axial contact against the cap body 26. The chamber 30 also recovers its initial volume.

In the second example illustrated on FIG. 6, in which identical parts are given identical references, the pump system 18 comprises a rigid push-button 40 mounted on a pushing rod 42 secured to the piston 16.

The pushing rod 42 extends axially from the piston 16 and protrudes outside of the container 12. The pushing rod 42 comprises a first upper end secured to the piston 16 and a second bottom end onto which is mounted the push-button 40. In the disclosed example, the pushing rod 42 and the piston 16 are made in one part. Alternatively, the pushing rod 42 may be a separate part which is secured to the piston 16 by any other appropriate means, for example by gluing, snap-fitting, etc. In the disclosed example, the pushing rod 42 has in cross-section a circular shape. Alternatively, the pushing rod 42 may have any other different profile in cross-section, for example a polygonal, a square or an oval one.

In this second example, the cap body 26 also comprises an inner frontal wall 26*c* extending radially inwards from the skirt 26*a*. Here, the frontal wall 26*c* extends radially the end of the skirt 26*a* located axially on the side opposite to the flange 26*b*. The cap body 26 closes off the container 12. The pushing rod 42 extends through the frontal wall 26*c*. The piston 16 axially abuts against the frontal wall 26*c*. The cap body 26 further comprises an annular skirt 26*d* projecting axially from the frontal wall 26*c* and sealingly engages into the piston 16. In this example, the skirt 26*a* of the cap body is provided with the ribs engaged into the recesses formed on the peripheral wall 12*a* of the container.

The push-button 40 is axially moveable with respect to the container 12 and the cap body 26. The push-button 40 is made in one part, for example from rigid plastic material such as polyethylene (PE), polypropylene (PP), etc. Alternatively, the push-button 40 may be made from metal.

The push-button 40 comprises a frontal wall 40*a* and an annular peripheral wall 40*b* extending axially said wall towards the container 12. The peripheral wall 40*b*, coaxial with the axis X-X', extends a large-diameter of the frontal wall 40*a*. The peripheral wall 40*b* extends axially into the flange 26*a* of the cap body.

The push-button 40 also comprises a skirt 40*c* projecting axially from the frontal wall 40*a* and mounted on the pushing rod 42. In the disclosed example, the mounting skirt 40*c* is provided with grooves (not referenced) into which engage ribs formed on the pushing rod 42 in order to secure the push-button 40 on said rod. Alternatively, the fixation between these two elements may be made by press-fitting, gluing, etc.

In the inactive position illustrated on FIG. 6, the push-button 40 remains axially and radially spaced apart from the cap body 26. The push-button 40 delimits together with the cap body 26 a closed space 44.

The pump system 18 further comprises an elastic spring 46 mounted inside the space 44. The spring 46 is axially interposed between the push-button 40 and the cap body 26. A first end of the spring 46 axially bears against the frontal wall 26*c* of the cap body while a second opposite axially bears against the frontal wall 40*a* of the push-button. The spring 46 exerts a permanent axial force on the push-button 40. The spring 46 is disposed radially around the pushing rod 42. In the illustrated example, the spring 46 is a compression spring. Alternatively, it could be possible to use other elastic element(s), for example a stack of washers such as Belleville washers.

In this second example, the cap body 26 of the pump system axially delimits together with the piston 16 a chamber 48. More particularly, the chamber 48 is axially delimited by the piston 16 and the frontal wall 26*c* of the cap body. The chamber 48 is separate from the compartment 22 by the piston 16. The chamber 48 is not in communication with the compartment 22 via the piston 16. Preferably, the chamber 48 is not in communication with the outside via the cap body 26. The chamber 48 may be delimited by cap body 26, the piston 16 and also the container 12 depending on the position of said piston. When no pressure is exerted on the push-button 40, the chamber 48 may be substantially at atmospheric pressure.

Once the cap of the device has been removed, from the inactive position illustrated on FIG. 7 to distribute the product contained into the compartment 22, the user exerts an axial pressure on the rigid push-button 40. The pressure is illustrated schematically by the arrow referenced 50 and applied on the frontal wall 40*a* of the push-button.

As shown on FIG. 8, with the pressure exerted by the user, the push-button 40 moves axially towards the container 12 and the cap body 26. The push-button 40 may move until the peripheral wall 40*b* abuts against the frontal wall 26*c* of the cap body.

During the axial movement of the push-button 40, the elastic spring 46 is compressed. Simultaneously, the piston 16, which is connected to the push-button 40 by the pushing rod 42, moves forward inside the container 12 towards the dispensing plug 14. The product is discharged through the outlet orifice 24 of the plug as illustrated schematically by the arrow 52. With such movement of the piston 16, the volume of the chamber 48 increases.

When the pressure exerted by the user is released, the push-button 40 returns towards its initial position by the action of the spring 46 as shown on FIG. 9. This also leads to a backward displacement of the piston 16 away from the dispensing plug 14, i.e. towards the push-button 40 and the cap body 26. Under the action of the spring 46, the push-button 28 and the piston 16 return to their initial position. The piston 16 returns into contact with the cap body 26. As a result, the chamber 48 recovers its initial volume. During the movement of the piston 16 towards the cap body 26, an air intake into the compartment 22 of the container is achieved only by the dispensing plug 14. The air intake is illustrated schematically by the arrow 54.

Thanks to the device according to the present invention, after dispensing the product, the release of the push-button leads to a backward displacement of the piston. Such an arrangement of the pump system forces air from being sucked by the dispensing member towards the internal compartment containing the product. This limits the dripping phenomenon even with a product having a low viscosity. This also helps the product in the dispensing member to return inside the internal product compartment of the container.

The invention claimed is:

1. Device for packaging and dispensing a product comprising:

a container, a moveable piston mounted inside the container and delimiting one compartment containing the product, a dispensing member mounted on the container and comprising at least one outlet orifice in communication with the compartment, and a pump system mounted on the container axially on the side opposite to the dispensing member and comprising a push-button delimiting at least partly a variable volume and closed space, wherein said pump system is configured so that exerting a pressure on the push-button results in a forward displacement of the piston inside the container towards the dispensing member, and subsequent releasing of said push-button results in a backward displacement of said piston away from said dispensing member and in an air suck back into the compartment of the container only through the outlet orifice of the dispensing member.

2. Device according to claim 1, wherein the push-button of the pump system is made from elastically deformable material.

3. Device according to claim 2, wherein the push-button of the pump system and the piston axially delimit a chamber separate from the compartment, the volume of the chamber being variable upon deformation of the push-button, said variable volume chamber being not in communication with the outside via the pump system.

4. Device according to claim 1, wherein the push-button of the pump system comprises a sealing skirt engaging into the container in a leaktight manner.

5. Device according to claim 1, wherein the push-button of the pump system is deprived of through-hole.

6. Device according to claim 1, wherein the pump system further comprises a cap body mounted on the container, the push-button being secured to said cap body.

7. Device according to claim 1, wherein the pump system further comprises a pushing rod secured to the piston and onto which is mounted the push-button.

8. Device according to claim 7, wherein the push-button is made from rigid material, said pump system further comprises at least one an elastic element disposed around the pushing rod for biasing said push-button outwards.

9. Device according to claim 7, wherein the pump system further comprises a cap body mounted on the container for closing off said container, the push-button being movable relative to said cap body.

10. Device according to claim 9, wherein the pushing rod extends through the cap body.

11. Device according to claim 9, wherein an elastic element is interposed between the push-button and the cap body.

12. Device according to claim 1, wherein the product contained in the compartment has a viscosity below 25 (M3) UD.

13. Device for packaging and dispensing a product comprising:

a container, a moveable piston mounted inside the container and delimiting one compartment containing the product, a dispensing member mounted on the container and comprising at least one outlet orifice in communication with the compartment, and a pump system mounted on the container axially on the side opposite to the dispensing member and comprising a push-button having a variable volume and deformable closed chamber with a confined quantity of air, wherein said pump system is configured so that exerting a pressure on the push-button results in a forward displacement of the piston inside the container towards the dispensing member, and subsequent releasing of said push-button results in a backward displacement of said piston away from said dispensing member and in an air suck back into the compartment of the container only through the outlet orifice of the dispensing member without adding air into the chamber of the push-button.

* * * * *